US010909890B1

(12) United States Patent
Apostle et al.

(10) Patent No.: US 10,909,890 B1
(45) Date of Patent: Feb. 2, 2021

(54) BACKLIT BANNER DISPLAY SYSTEM

(71) Applicant: Orbus, LLC, Woodridge, IL (US)

(72) Inventors: James J. Apostle, Shorewood, IL (US); Drew A. Adams, Glenview, IL (US); Dmitri Doubovikov, Vernon Hills, IL (US); Ryan W. Duever, Sycamore, IL (US)

(73) Assignee: Orbus, LLC, Woodridge, IL (US)

( * ) Notice: Subject to any disclaimer, the term of this patent is extended or adjusted under 35 U.S.C. 154(b) by 0 days.

(21) Appl. No.: 16/800,767

(22) Filed: Feb. 25, 2020

Related U.S. Application Data

(60) Provisional application No. 62/931,526, filed on Nov. 6, 2019.

(51) Int. Cl.

| | |
|---|---|
| ***G09F 11/02*** | (2006.01) |
| ***G09F 13/04*** | (2006.01) |
| ***G09F 15/00*** | (2006.01) |
| ***G09F 13/18*** | (2006.01) |
| ***G09F 13/20*** | (2006.01) |
| ***G09F 17/00*** | (2006.01) |

(52) U.S. Cl.
CPC ..... *G09F 13/0413* (2013.01); *G09F 13/18* (2013.01); *G09F 13/20* (2013.01); *G09F 15/0012* (2013.01); *G09F 15/0062* (2013.01); *G09F 17/00* (2013.01); *G09F 2013/049* (2013.01); *G09F 2013/0445* (2013.01); *G09F 2013/0463* (2013.01); *G09F 2013/1877* (2013.01)

(58) Field of Classification Search
CPC ..... G09F 11/00; G09F 11/02; G09F 11/08; G09F 11/18; G09F 11/29; G09F 13/0413; G09F 15/0012; G09F 13/18; G09F 13/20; G09F 2013/0463; G09F 2013/049; G09F 2013/1877; G09F 2013/0445; G09F 15/0025; G09F 15/0062; G09F 17/00; A47B 97/02; G09B 29/06; E06B 9/40; E06B 9/42; E06B 2009/2423; E06B 2009/2447; E06B 2009/2452; E06B 2009/405
See application file for complete search history.

(56) References Cited

U.S. PATENT DOCUMENTS 765,464 A * 7/1904 Flachsbart ..... G09F 11/29 40/518
981,184 A * 1/1911 Fitch ..... G09F 7/12 40/515
3,990,635 A * 11/1976 Restle ..... F24S 20/63 126/591
4,220,189 A * 9/1980 Marquez ..... E06B 9/17076 160/23.1
D616,944 S * 6/2010 Taylor ..... G09F 15/0062 D20/10

(Continued)

*Primary Examiner* — Cassandra Davis
(74) *Attorney, Agent, or Firm* — Leydig, Voit & Mayer, Ltd.

(57) ABSTRACT

A display system includes a rectangular frame that is surrounded on four sides and is open on two opposed faces. Two banners are disposed to cover the two open faces to enclose a space within the frame. At least one light emitting device is connected to the frame and disposed within the space. The two banners are backlit by the at least one light emitting device when each is in its respective extended position.

20 Claims, 8 Drawing Sheets

(56) References Cited

U.S. PATENT DOCUMENTS

| | | | | |
|---|---|---|---|---|
| 8,169,698 | B1 * | 5/2012 | Robinson | G03B 21/56 359/449 |
| 10,109,222 | B1 * | 10/2018 | Nuss | G09F 17/00 |
| 10,205,918 | B2 | 2/2019 | Niedermeyer et al. | |
| 10,433,439 | B2 * | 10/2019 | Pecorino | G09F 11/08 |
| 2008/0263921 | A1 * | 10/2008 | Kim | G09F 11/29 40/407 |
| 2010/0050489 | A1 * | 3/2010 | Merner | G09F 15/0025 40/604 |

* cited by examiner

BACKLIT BANNER DISPLAY SYSTEM

CROSS-REFERENCE TO RELATED APPLICATIONS

This patent application claims the benefit of U.S. Provisional Patent Application No. 62/931,526, filed Nov. 6, 2019, which is incorporated here by reference for all purposes.

FIELD OF THE DISCLOSURE

The present disclosure is directed to tradeshow displays and, more particularly, to backlit banner displays.

BACKGROUND OF THE INVENTION

Retractable banner displays are generally known for supporting banners in an upright position to display graphics printed thereon. A typical retractable banner display can include a housing that surrounds and rotatably supports a cylinder onto which the banner is rolled. When displayed, the banner is unrolled from the cylinder by pulling a bar connected onto a free end of the banner. A support leg, which is connected to the housing or stands on a floor, connects to the bar and holds it upright so that the banner remains in the unrolled and upright position for visually displaying graphics printed on the banner, usually on one side.

To improve visibility of the banner, lighting can be used to shine onto the banner when in the extended position. One previously proposed solution incorporates light bars along the pull bar and housing, which emit light that shines onto the printed side of the banner, as shown, for example, in U.S. Pat. No. 10,109,222 (the '222 patent). The '222 patent describes a banner that extends from a base that includes a roller cylinder. A free end of the banner is connected to a pull bar. Each of the base and pull bar includes a light strip such that, when the banner is extended and the pull bar is supported in an upright position by a leg, the two light strips are disposed at the top and bottom of the banner.

While the solution proposed in the '222 patent may be an improvement over using external lighting fixtures to illuminate a printed side of a banner, the additional weight of the light strip along the light bar makes installation of the banner more difficult and requires additional support from the support leg. Further, the position of the light strips along the top and bottom of the banner may not fully illuminate an entire area of the banner and may further obscure view of certain portions of the banner, especially when used on banners made with glossy graphics, and cannot be used to illuminate both sides of a dual-sided banner display. Accordingly, an improved system and method for illuminating banners is needed.

BRIEF SUMMARY OF THE DISCLOSURE

In one aspect, the present disclosure describes a display system that includes a frame having a rectangular shape, which is surrounded on four sides and is open on two opposed faces. The frame defines a space therein between two sidewalls, a top wall and a base. The base forms two cavities extending parallel to at least a portion of the frame. Two rollers are disposed, one each, into the two cavities. Each of the two rollers is rotatably supported relative to the base. Two banners are further included, each banner having one end attached to a respective one of the two rollers and another end connected to a draw bar extending in parallel with the two rollers. At least one light emitting device is connected to the frame and disposed within the space defined in the frame. Each of the two banners is retractable into the base by being rolled onto the respective one of the two rollers to which each of the two banners is connected, and each of the two banners is extendable to cover one of the two opposed faces that is open between a retracted position, in which the banner is rolled onto one of the two rollers and disposed within the cavity in the base, and an extended position, in which the draw bar is connected to the top wall and the banner is at least partially unrolled from the respective roller. The two banners are backlit by the at least one light emitting device when each is in its respective extended position.

In another aspect, the disclosure describes a display system for a banner that includes a frame having a rectangular shape that is surrounded on four sides by two sidewalls, a top wall, and a bottom wall. The frame defines a space therein that is open on two sides. Two banners are further included, each banner disposed to cover one of the two sides of the frame that is open to enclose the space. Each of the two sidewalls forms a channel along both open sides of the frame that are open, for a total of four channels. Each of the two banners has a side edge disposed in a respective one of the four channels. At least one light emitting device is connected to the frame and disposed within the space. The two banners are backlit by the at least one light emitting device, and an overlap between the side edges of the banners and the four channels prevents light from escaping between the banners and the frame.

DETAILED DESCRIPTION OF THE INVENTION

The present disclosure is directed to tradeshow displays and, more particularly, to a display system and method for providing an illuminated banner. In the exemplary embodiments described herein, an enclosable structure is described that includes internal lighting to illuminate one or two banners disposed to enclose the structure when extended from behind. Is some embodiments, the banners include external faces, onto which graphics are printed, and internal faces, which may optionally include a light-sensitive coating, which provides a uniform illumination through a light-permeable material of the banners without shadows or unevenly lit portions of the banners, as is the case with existing banner illumination systems. In addition, the tradeshow display system described herein is assembled using modular components such that a single assembly of components can be structured into more than one size and/or configuration without use of additional components or tools, so that one banner display can be used to display more than one banner face to the public.

Figure 1:
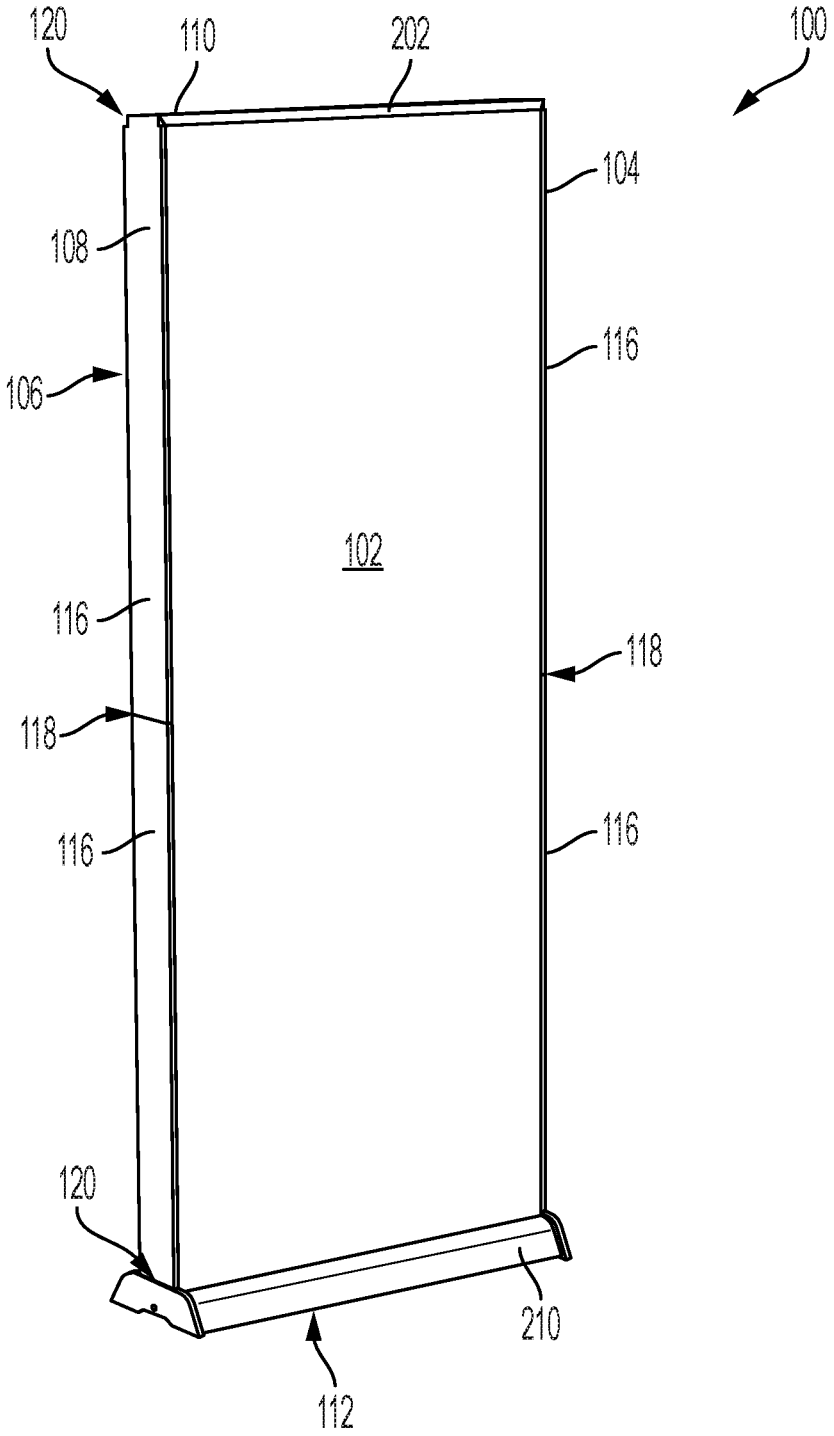
FIG. 1 is an outline view of a display system in accordance with the disclosure.
Figure 2:
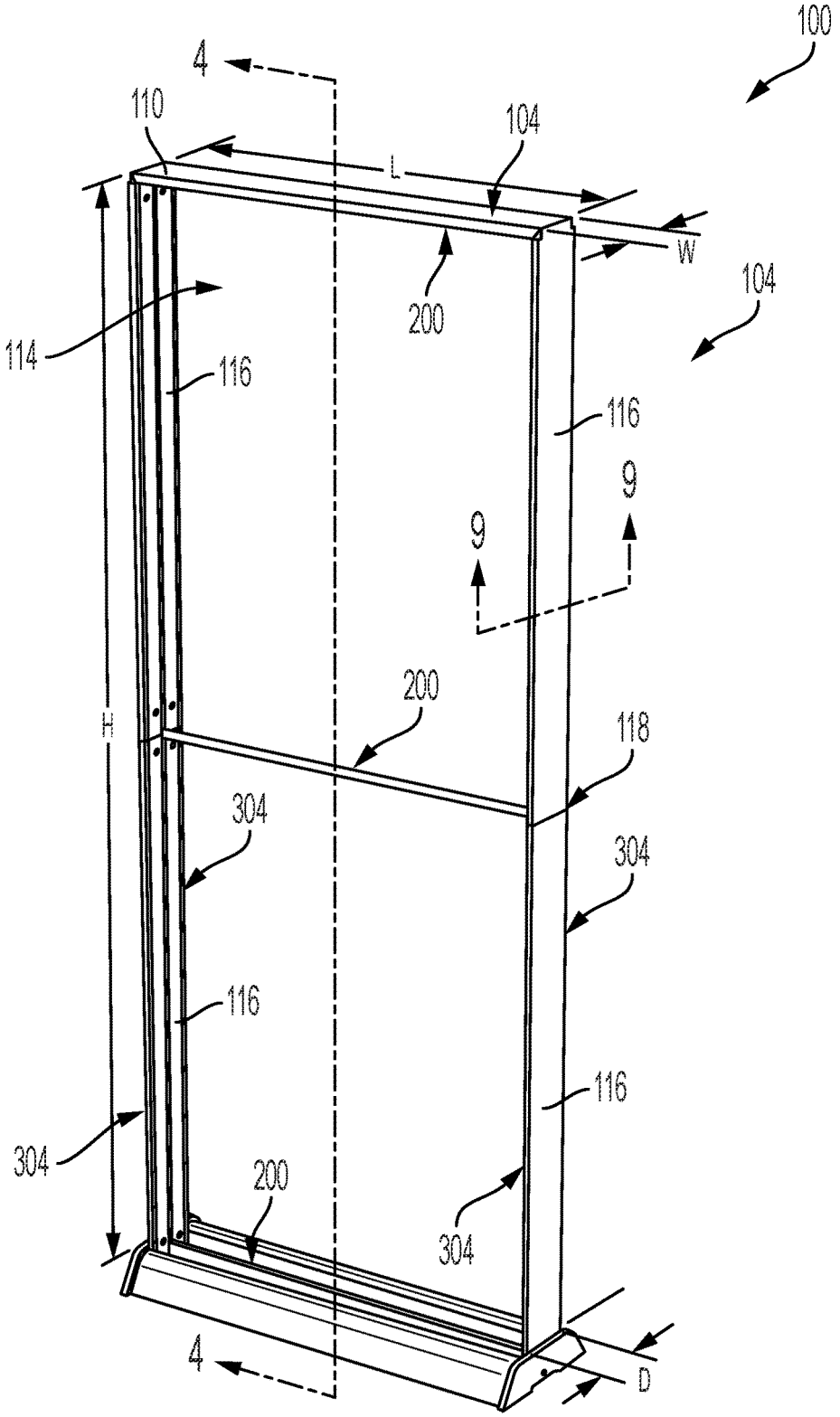
FIG. 2 is an outline view of the display system of FIG. 1 with a banner in a retracted position.
Figure 3:
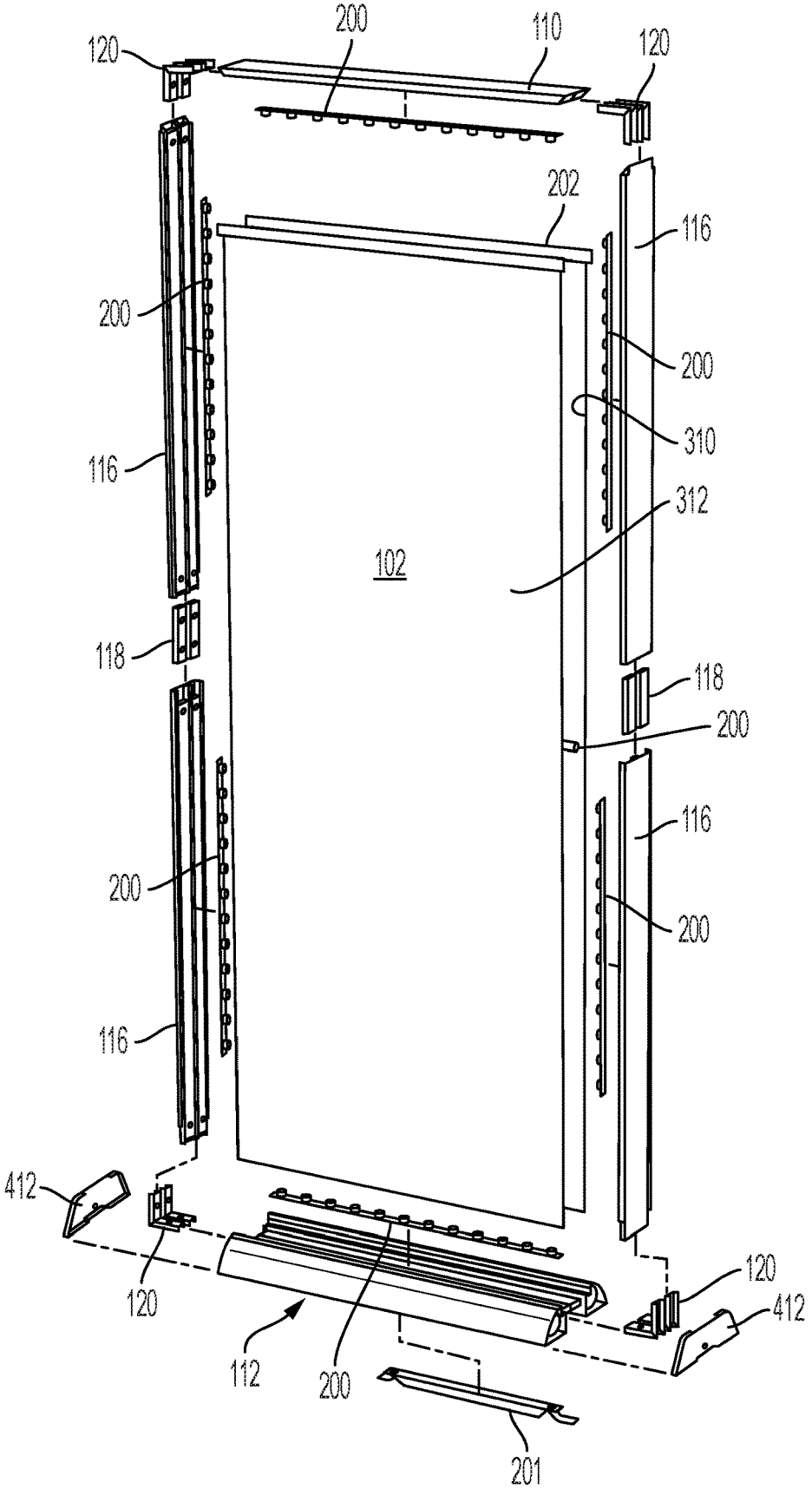
FIG. 3 is an exploded view of the display system of FIG. 1.

A first exemplary embodiment for a display system 100 is shown in FIG. 1 in a service position, in which two banners 102 are in an extended position, and in FIG. 2 with the banners 102 in their respective retracted positions. An exploded view of the display system 100 is shown in FIG. 3. In reference to these figures, the display system 100 includes a frame 104 having a generally rectangular-shaped wall 106 that includes two sidewalls 108, a top wall 110 and a base 112. The wall 106 surrounds a space 114 having a length, L, defined by the top wall 110, a height, H, defined with the sidewalls 108, and a depth, D, defined by a wall width, W, as shown in FIG. 2. As can be appreciated, the base 112 can be optional such that the frame 104 is completed by another wall and the banner is attached to the frame.

In the illustrated embodiment, certain components of the frame 104 are collapsible or configured for selective assembly or disassembly to provide flexibility in the size and configuration of the frame 104 during use, and also to enable disassembly for easy packaging and transport of the display system 100. More specifically, in the embodiment shown, each of the sidewalls 108 is made of two elongate segments 116, which are connected end to end to one another at a joint 118. The joint 118 may be rigid or able to pivot the two segments 116, so they remain connected. Angled joints 120, which can similarly be rigid or alternatively configured for selective pivotal movement between adjacent structures of the frame 104 are disposed between the sidewalls 108 and the top wall 100.

When the display system is in a deployed or service position, the joins 118 rigidly retain the sidewall segments 116 in a straight position, and the angled joints 120 retain their respective surrounding structures at an angled configuration to form the rigid, rectangular frame 104. The banners 102 can extend out from the base 112 and close off the front and rear openings of the space 114 to form a six-sided closed box shape having the banners and their graphics exposed on a front and rear side, and being otherwise enclosed around the banners on four sides such that a hollow and enclosed space remains between the two banners.

Figure 7:
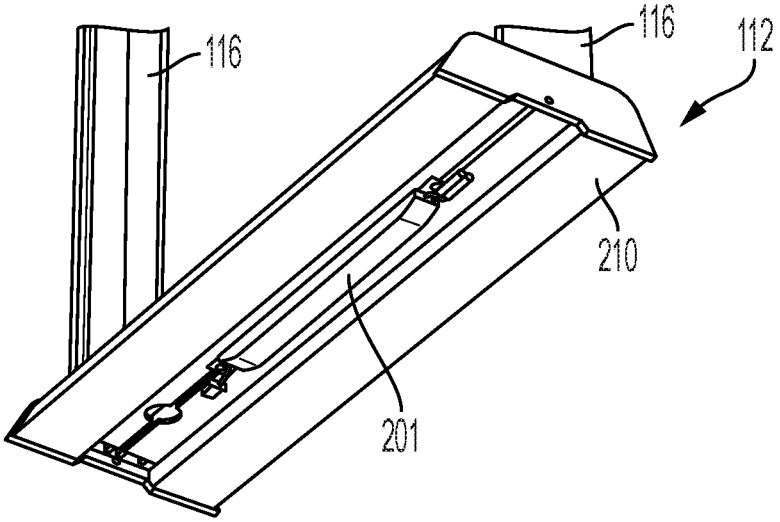
FIG. 7 is a fragmented view of a base portion of the display system of FIG. 1.
Figure 8:
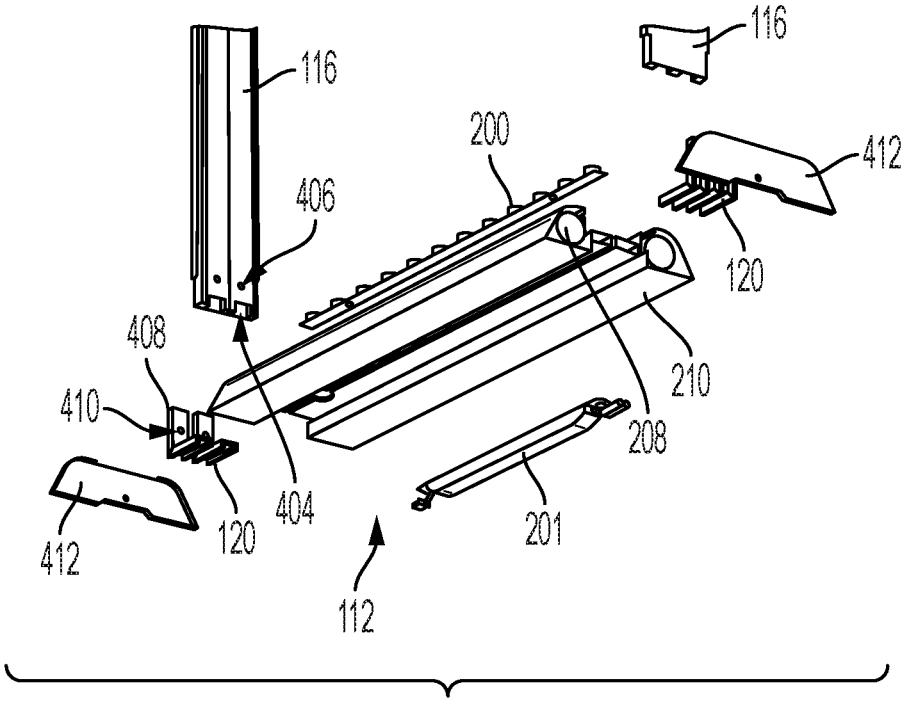
FIG. 8 is an exploded view of the structures shown in FIG. 7.
Figure 10:
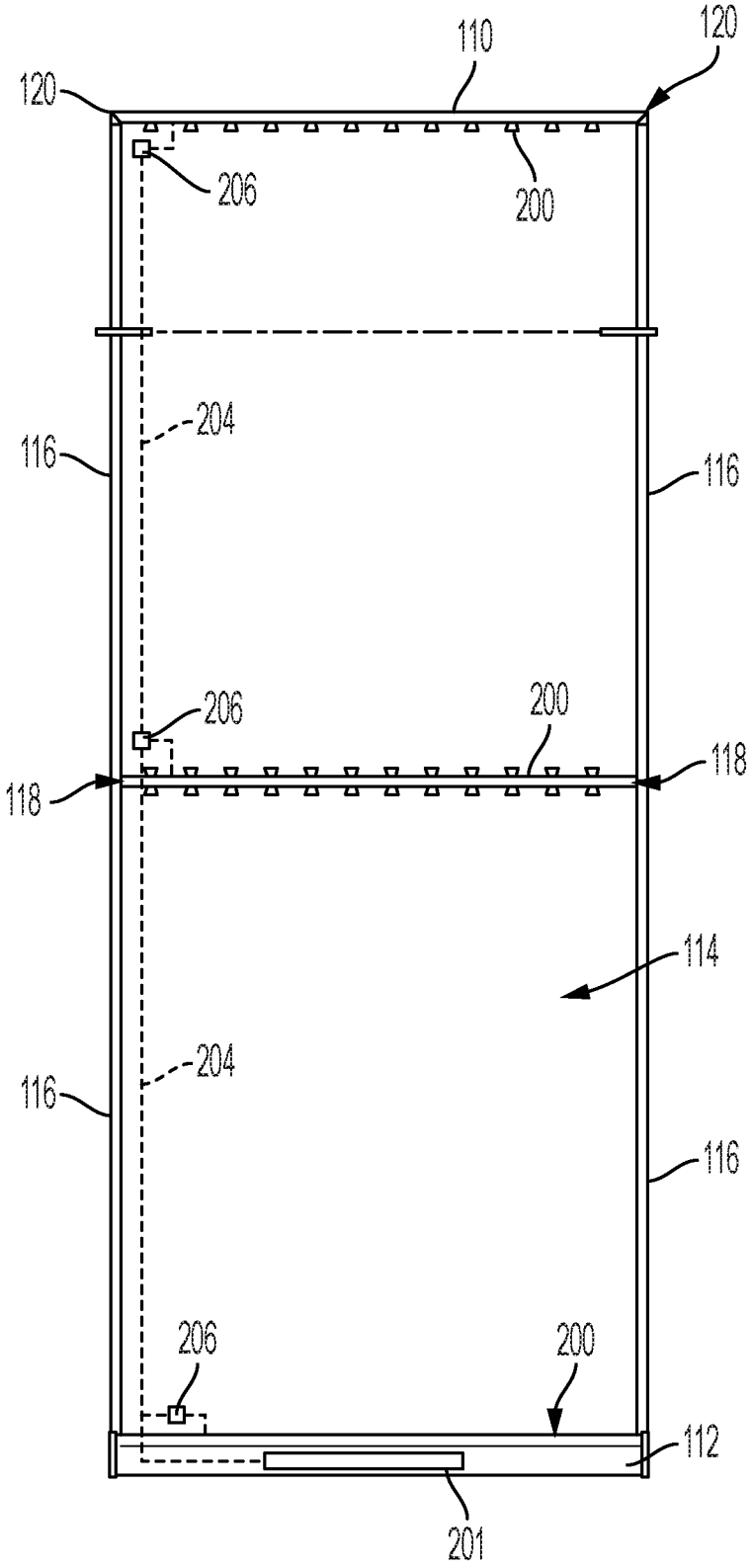
FIG. 10 is an alternative embodiment for a display system.

In reference to FIGS. 2 and 3, it can be seen that the frame 104 further includes at least one light source, which in the illustrated embodiment is embodied as a light emitting diode (LED) light strip 200. As shown, there is at least one LED strip 200 attached to the base 112, with additional LED strips 200 being attachable across the sidewalls 108, for example, at a half-height position, along the top wall 110 facing the space 114, and along the segments 116, also facing the space 114. These possible placements of the LED light strips 200 can be best seen in the exploded view of FIG. 3. While seven possible positions for the LED strips 200 are shown, it should be appreciated that fewer or more can be used. For example, adequate lighting of the banners 102 can be accomplished with as few as two LED strips 200 placed along the top and bottom portions of the space 114. A transformer or battery 201 may be connected in a concealed fashion under the base 112, as shown in FIGS. 7 and 8, and connected with wiring 204 to power all LED strips 200. The wiring 204 may extend along the frame and include connectors 206 that allows for separation of frame segments and also connection to the LED strips 200 that may be disposed onto frame segments such as the sidewall segments 116, the top wall 110, the base 112, and so forth, as shown in FIG. 10.

Figure 4:
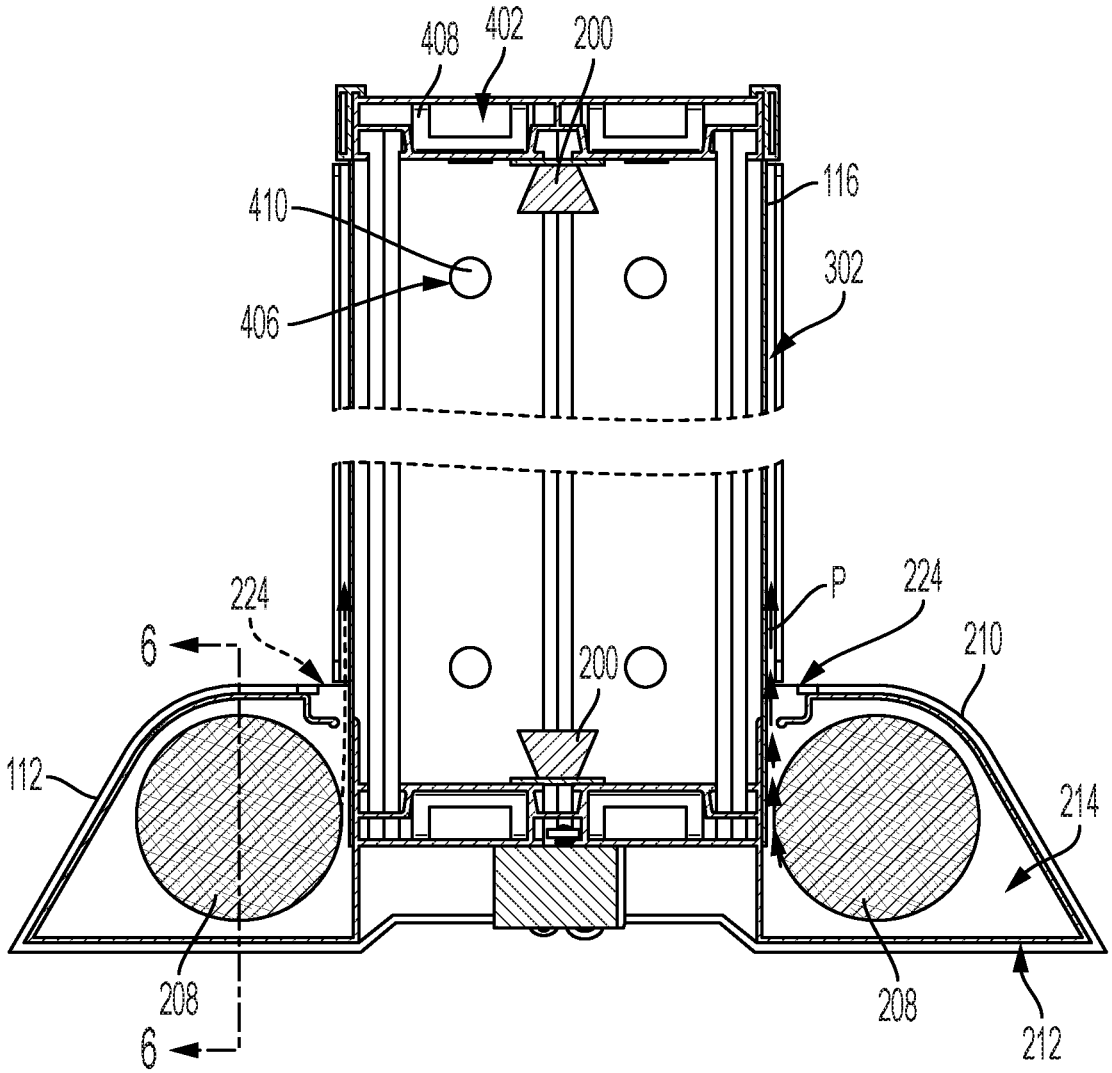
FIG. 4 is an enlarged, cross section view through a portion of the display system of FIG. 1.
Figure 5:
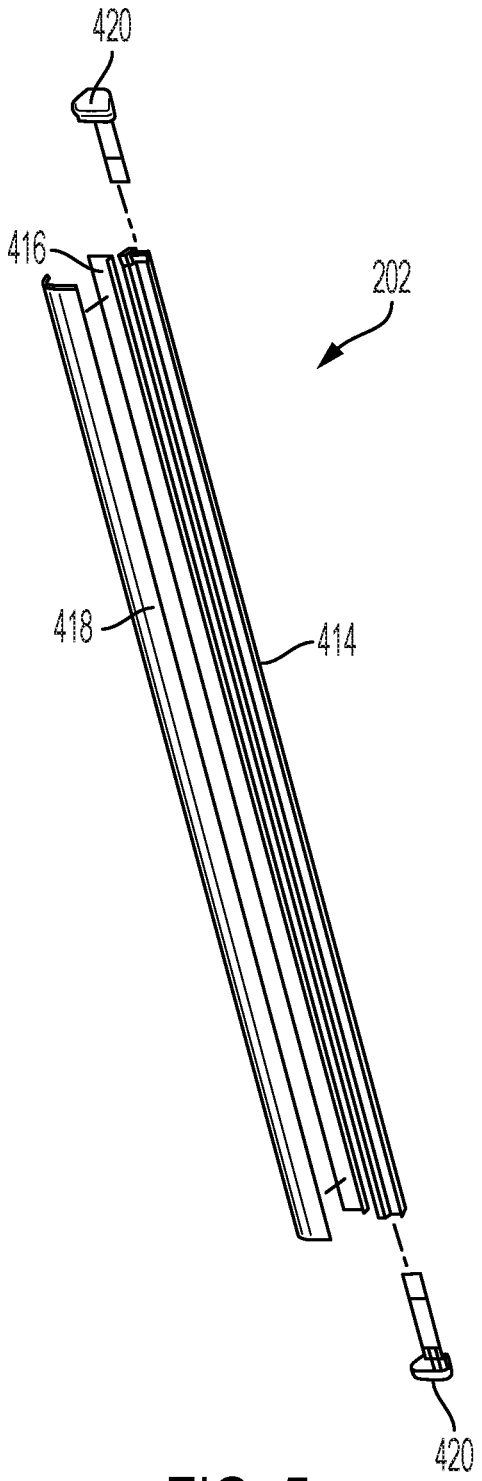
FIGS. 5 and 6 are outline views of components of the display system of FIG. 1.
Figure 6:
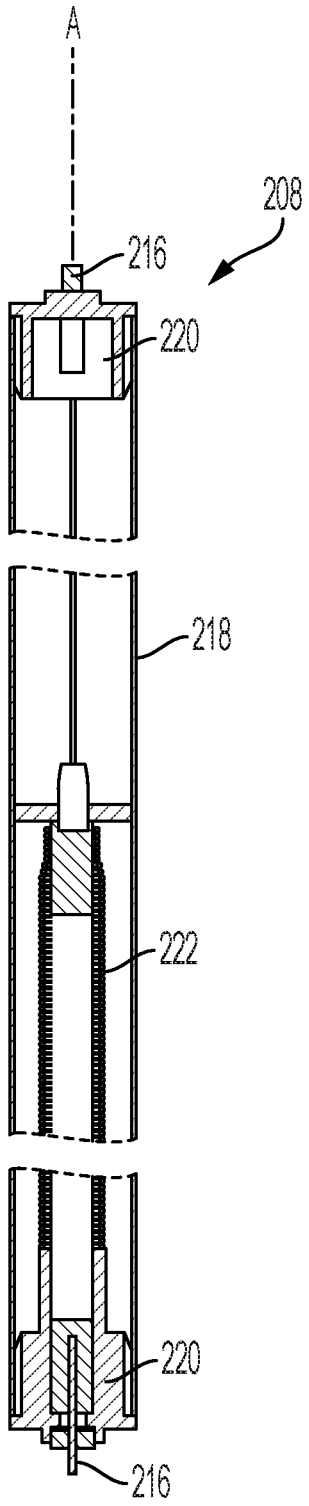

In use, each of the two banners 102 has a free end onto which a bar assembly 202 is connected. The bar assembly 202 may include a retaining bar 414, a spacer 416, and a locking bar 418 that are finished by two endcaps 420 to enable easy removal and reattachment of the bar onto the banner, as shown in FIG. 5. An opposite end is connected to rollers 208 that are rotatably disposed within the base 112 and, more specifically, within a hollow and elongate housing 210 as shown in the cross section of FIG. 4. The housing 210 has a wide base 212 and a generally trapezoidal cross section that defines two pockets 214 into which the rollers 208 are disposed. The rollers 208 extend parallel to one another and include end pins 216 that permit their rotatable mounting on the base 112 within the pockets 214. As shown, a rotation axis A of each of the two rollers is parallel to the rotation axis of the second roller and also to the length L dimension of the space 114. Each roller 208 may further be spring-loaded to permit a powered retraction of the respective banner, as shown in FIG. 6, where a drum 218 onto which the banner 102 may be wound is disposed between two end caps 220 and a spring 222, in the typical fashion.

When the banner 102 is extended or retracted relative to the base 112, it winds or unwinds relative to its respective roller 208 disposed within the housing 210 as a user pulls up or allows the bar assembly 202 to retract down. The material of the banner 102 passes through a respective slot 224 (two shown in FIG. 4) that extends lengthwise along the base 112 in the area adjacent an outer end of the sidewalls 108.

Figure 9:
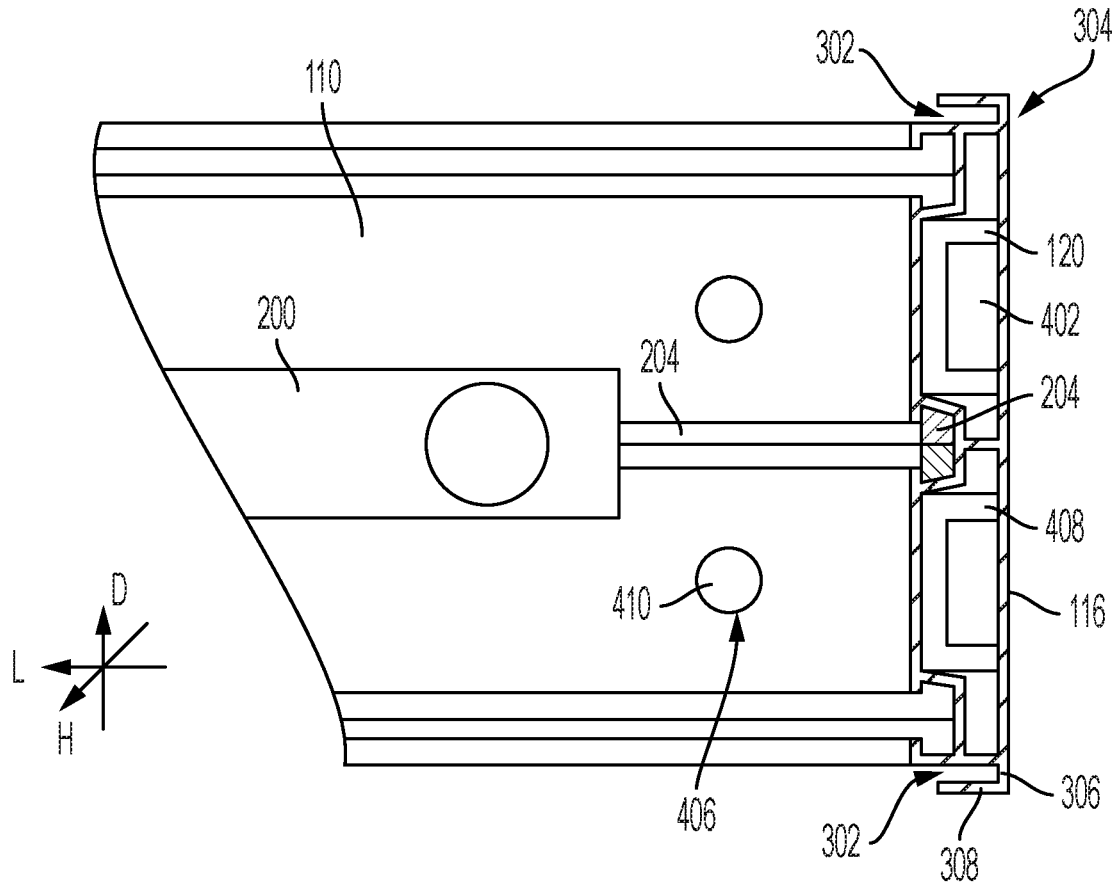
FIG. 9 is an enlarged detail of a cross section through a portion of the display system of FIG. 1.

Each sidewall 108, as shown in FIG. 9 in cross section, includes two channels 302 extending along the length of the sidewall 108, that is, along the front and rear side edges 304 of the space 114 (see FIG. 2) and along the entire height (H) of the space 114. Each channel 302 is enclosed on three sides when viewed in cross section between a portion of each wall segment 116, and an L-shaped wall that includes a depth-wise (D) wall portion 306 and a length-wise (L) wall portion 308. The channels 302, along with the slots 224, together form a frame or area that surrounds the edges of banner 102 to form a barrier against light escaping from within the space 114 when the banners 102 are in the extended position.

Each banner 102 may be made from a fabric material having an inner-facing side 310 and an outer facing side 312 (see FIG. 3). When installed, the two banners 102 have their inner-facing sides 310 facing one another and also the space 114, and their outer facing sides 312, onto which graphics may be printed, facing outwardly relative to the space 114 and away from one another. The material of each banner 102 may be made from a light-permeable fabric or composite, and may optionally include a reflective or luminescing coating along its inner-facing side 310 to diffuse and reflect light so that a uniform intensity of lighting can exist within the space 114, similar to a light-box. In this way, the lighting provided to the extended banners 102 can appear uniform and of an even intensity across the entire surface of each banner 102 when viewed externally and while the LED strips 200 are illuminated or active.

Advantageously, the frame 104 is of a modular construction, meaning, that interchangeable frame members can be used to create the frame 104 as shown in FIG. 2, and also variations of that frame, for example, one configured for a banner having half the height of the banners shown in FIG. 1, in the event alternative presentations are desired using the same display system. For example, one banner 102 on one side of the system may extend the full height, H (see FIG. 2), while the banner 102 on the other side may include graphics extending only half the height (H/2) such that a full display or a smaller display can be presented depending on the orientation of the display system 100 on the floor relative to spectators.

For assembling the frame 104 in a different configuration, the joints 118 and two segments 116 may be omitted from the assembly, and the angled joints 120 along with the top wall 110 assembled on the lower pair of segments 116. This is possible because the interfaces between the various joints and wall segments are interchangeable. As can be seen in FIGS. 3 and 4, and also FIGS. 8 and 9, each wall segment, for example, the side segments 116, can be made from Aluminum extrusions that include elongate cavities 402 extending along their entire length. At their ends, the cavities may include a cutout 404 and openings 406 disposed at an offset distance from and end of each cutout. The connectors 118 or 120 may include ribs 408 that slide into the cavities 402 to align the connectors with the respective wall segments. Spring loaded buttons 410 may be depressed to allow passage of the rib 408 into the cavity 402 and spring into an extended position, providing an audible clicking sound, when the button 410 has aligned with the opening 406, in this way securing the rib 408 onto the wall segment. During disassembly, the button 410 may be pressed by a user to allow sliding of the rib 408 back out from the cavity 402.

The arrangement, dimensions and spacing of the wall segment cutouts, openings, ribs, and buttons may be made the same for any connection point such that straight or angled joints may be used interchangeably to build different frames using the same group of components. Certain joints may be more permanently positioned, for example on the base 112 covered by caps 412, while others may be removably connected to the frame 104. In one embodiment, both sides of the joints 118 or 120, each of which includes corresponding rib(s) 408 and button(s) 410 may be rigidly disposed at any desired angle or may alternatively be hinged to permit rotation of segments relative to one another without requiring disassembly of the wall segments.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A display system, comprising: a frame having a rectangular shape with four sides and is open on two opposed faces, the frame defining a space therein between two sidewalls, a top wall and a base, wherein the base forms two cavities extending parallel to at least a portion of the frame; two rollers disposed, one each, into the two cavities, each of the two rollers being rotatably supported relative to the base; two banners, each banner having one end attached to a respective one of the two rollers and another end connected to a draw bar extending in parallel with the two rollers; and at least one light emitting device connected to the frame and disposed within the space defined in the frame; wherein each of the two banners is retractable into the base by being rolled onto the respective one of the two rollers to which each of the two banners is connected; wherein each of the two banners is extendable to cover one of the two opposed faces that is open between a retracted position, in which the banner is rolled onto one of the two rollers and disposed within the cavity in the base, and an extended position, in which the draw bar is connected to the top wall and the banner is at least partially unrolled from the respective roller; and wherein the two banners are backlit by the at least one light emitting device when each is in its respective extended position.

2. The display system of claim 1, wherein the at least one light emitting device is disposed on the base, and wherein a second light emitting device is disposed on the top wall.

3. The display system of claim 1, wherein the frame has a length, height and width, and wherein the two sidewalls extend in parallel in a height direction, the top wall and the base extend in parallel in a length direction, and the two opposed faces are open in a width direction.

4. The display system of claim 1, wherein each of the two sidewalls includes two wall segments connected to one another by a straight joint, the joint being releasably attachable between the two wall segments, and wherein each of the two sidewalls is connected to the top wall and to the base at each end by a respective angled joint such that four angled joints are disposed at four corners of the frame, each of the four angled joints being releasably attachable on the frame.

5. The display system of claim 4, wherein each wall segment has an elongate shape formed by an extrusion that includes at least one cavity, the cavity including an opening adjacent one end, and wherein the straight joint includes a rib configured to slide into the cavity to align the wall segment with an adjacent wall segment.

6. The display system of claim 5, wherein the rib includes a spring loaded button that is depressed and automatically extends when the rib is disposed in the cavity and the spring loaded button is aligned with the opening.

7. The display system of claim 4, wherein at least one of the angled and straight joints includes a pivot permitting adjacent structures of the frame to pivot relative to one another.

8. The display system of claim 1, further comprising two channels formed along the two sidewalls on either side of the two opposed faces that are open, the two channels being open in faced relation such that side margins of each of the two banners in the extended positions are disposed at least partially within the two channels on either side.

9. The display system of claim 8, further comprising two slits formed in the base and extending parallel to the two rollers, wherein the two banners extend, one each, through the two slits and are further extendable into the two channels on either side.

10. The display system of claim 1, wherein each of the two banners is made from a light permeable fabric that includes graphics printed on one side and a luminescent material deposited on a second side.

11. A display system for a banner, comprising:

a frame having a rectangular shape with four sides having two sidewalls, a top wall, and a bottom wall, the frame defining a space therein that is open on two sides;

two banners, each banner disposed to cover one of the two sides of the frame that is open to enclose the space;

wherein each of the two sidewalls forms a channel along both open sides of the frame that are open, for a total of four channels;

wherein each of the two banners has a side edge disposed in a respective one of the four channels; and at least one light emitting device connected to the frame and disposed within the space, wherein the two banners are backlit by the at least one light emitting device, and wherein an overlap between the side edges of the banners and the four channels prevents light from escaping between the banners and the frame.

12. The display system of claim 11, wherein the at least one light emitting device is disposed on the bottom wall, and wherein a second light emitting device is disposed on the top wall.

13. The display system of claim 11, wherein the frame has a length, height and width, and wherein the two sidewalls extend in parallel in a height direction, the top wall and the bottom wall extend in parallel in a length direction, and the two opposed faces are open in a width direction.

14. The display system of claim 11, wherein each of the two sidewalls includes two wall segments connected to one another by a straight joint, the joint being releasably attachable between the two wall segments, and wherein each of the two sidewalls is connected to the top wall and to the bottom at each end by a respective angled joint such that four angled joints are disposed at four corners of the frame, each of the four angled joints being releasably attachable on the frame.

15. The display system of claim 14, wherein each wall segment has an elongate shape formed by an extrusion that includes at least one cavity, the cavity including an opening adjacent one end, and wherein the straight joint includes a rib configured to slide into the cavity to align the wall segment with an adjacent wall segment.

16. The display system of claim 15, wherein the rib includes a spring loaded button that is depressed and automatically extends when the rib is disposed in the cavity and the spring loaded button is aligned with the opening.

17. The display system of claim 14, wherein at least one of the angled and straight joints includes a pivot permitting adjacent structures of the frame to pivot relative to one another.

18. The display system of claim 11, further comprising a base connected to the bottom wall, the base containing two rollers that are rotatably disposed on the base and that are configured to roll the banners, one each, and to enclose the banners in the base when the banners are in a retracted position.

19. The display system of claim 18, further comprising two slits formed in the base and extending parallel to the two rollers, wherein the two banners extend, one each, through the two slits and are further extendable into the two channels on either side.

20. The display system of claim 11, wherein each of the two banners is made from a light permeable fabric that includes graphics printed on one side and a luminescent material deposited on a second side.

* * * * *